US012733700B2

(12) United States Patent
Li et al.

(10) Patent No.: US 12,733,700 B2
(45) Date of Patent: Sep. 15, 2026

(54) GLOVE STRUCTURE

(71) Applicant: JOHN ENGINE SPORTS PRODUCTS INC, Shanghai (CN)

(72) Inventors: Qingfeng Li, Shanghai (CN); Wenlan Cai, Shanghai (CN)

(73) Assignee: JOHN ENGINE SPORTS PRODUCTS INC., Shanghai (CN)

( * ) Notice: Subject to any disclaimer, the term of this patent is extended or adjusted under 35 U.S.C. 154(b) by 0 days.

(21) Appl. No.: 18/693,349

(22) PCT Filed: Sep. 7, 2022

(86) PCT No.: PCT/CN2022/117483
§ 371 (c)(1),
(2) Date: Mar. 19, 2024

(87) PCT Pub. No.: WO2023/045757
PCT Pub. Date: Mar. 30, 2023

(65) Prior Publication Data

US 2024/0398051 A1 Dec. 5, 2024

(30) Foreign Application Priority Data

Sep. 23, 2021 (CN) ..... 202111118812.2

(51) Int. Cl.
*A41D 19/00* (2006.01)

(52) U.S. Cl.
CPC ..... *A41D 19/0006* (2013.01)

(58) Field of Classification Search
CPC ..... A41D 19/0006; A41D 19/01523; A41D 19/015; A41D 19/01517; A41D 19/01547;
(Continued)

(56) References Cited

U.S. PATENT DOCUMENTS 4,411,024 A * 10/1983 Hayes ..... A63B 71/145 2/161.1
4,747,163 A * 5/1988 Dzierson ..... A41D 19/01523 2/164

(Continued)

FOREIGN PATENT DOCUMENTS

CN 103415223 A 11/2013
CN 105848506 A 8/2016
CN 113812704 A 12/2021

OTHER PUBLICATIONS

Office Action for the corresponding Chile Appln.202400844 issued on Apr. 23, 2025; pp. 1-11.

*Primary Examiner* — F Griffin Hall
(74) *Attorney, Agent, or Firm* — MUNCY, GEISSLER, OLDS & LOWE, P.C.

(57) ABSTRACT

At least a glove part covers a glove core of a glove structure to simulate dermis and epidermis of skin. The glove part is formed with a lamination region which caves downwards from a top surface of the glove part and has a long strip shape along an extending direction, and the lamination region acts as the sulcus cutis of the palm prints of the epidermis. The lamination region has an adhesion region, a bottom portion, protruding portions and sinking sections. A portion of the top surface not formed with the lamination region has at least a non-lamination region. The bottom portion between the protruding portion and the non-lamination region acts as the sulcus cutis. The protruding portions of the bottom portion act as the crista cutis of the palm prints. The sinking section between the adjacent protruding portions acts as the sinking region of the palm prints.

16 Claims, 12 Drawing Sheets

(58) Field of Classification Search
CPC ..... A41D 19/01564; A41D 19/01576; A63B 71/141; A63B 73/146; A63B 73/143
See application file for complete search history.

(56) References Cited

U.S. PATENT DOCUMENTS 5,581,809 A * 12/1996 Mah ..... A41D 19/01523 2/161.1
5,675,839 A * 10/1997 Gordon ..... A41D 19/01523 2/163
6,618,860 B1 * 9/2003 Sullivan ..... A41D 19/01523 2/161.1
6,845,519 B2 * 1/2005 Garneau ..... A41D 19/01523 2/161.1
7,478,440 B2 * 1/2009 Dolenak ..... A41D 19/01529 2/163
7,578,006 B2 * 8/2009 Garneau ..... A41D 19/01523 2/161.3
7,803,438 B2 9/2010 Flather et al.
8,950,015 B2 * 2/2015 Gibby ..... A41D 19/001 2/163
9,032,553 B2 * 5/2015 Bevier ..... A41D 19/0006 2/161.3
9,241,519 B2 * 1/2016 Jaeger ..... A41D 19/01523
9,266,263 B1 * 2/2016 Jaeger ..... A41D 19/01529
9,346,202 B2 * 5/2016 Gellis ..... A41D 19/01558
10,104,924 B2 * 10/2018 Dassler ..... A63B 71/1225
10,201,744 B2 * 2/2019 Abdelmalek .... A41D 19/01523
11,737,502 B2 * 8/2023 Storey ..... A63B 71/143 2/164
2014/0325740 A1 * 11/2014 Garneau ..... A63B 69/16 2/167
2016/0120242 A1 * 5/2016 Thompson ..... A41D 19/001 2/169
2017/0027255 A1 2/2017 Gellis
2018/0193718 A1 7/2018 Gilday et al.
2018/0303176 A1 * 10/2018 Lim ..... A41D 19/01505

* cited by examiner

GLOVE STRUCTURE

BACKGROUND

Technical Field

The present disclosure relates to a functional structure of a glove structure, and in particularly to, a glove structure which can increase a grasping force and a friction force.

Related Art

Human beings have known for the first time that they can protect their hands from harm by attaching a glove structure to their hands. Human hands often need to grasp. When grasping, muscle activities will form skin folds and become palm prints. In U.S. Patent Publication No. US2018/0193718A1 (hereinafter referred to as Document 1), grooves are formed on a palm of a glove structure to simulate the palm prints of the hand to increase the convenience of the glove structure when grasping.

However, the palm prints of the hand are not actually formed by just grooves. Referring to FIG. 1, the palm prints A of the hand are actually formed by a plurality of crista cutis A1 and a plurality of sulcus cutis A2, wherein the crista cutis A1 is protruding, and the plurality of sulcus cutis A2 caves downwards at two sides of the crista cutis A1. At the junction of the dermis B and epidermis C of the skin, there are many small papillary protrusions at the top of the dermis B, called dermal papilla B1. The dermal papilla B1 protrudes toward the epidermis C and forms a series of papillary lines, called crista cutis A1. Referring to FIG. 2A and FIG. 2B, the palm prints A formed by the crista cutis A1 and the sulcus cutis A2 present a chain-shaped section A3. The chain-shaped section A3 has at least a section of the plurality of the crista cutis A1 which are formed by arranging a plurality of protruding regions A11 along the extending direction of the palm prints A, and the sinking region A12 is formed between the adjacent protruding regions A11. In terms of the thickness direction of the hand, the height of the protruding region A11 is the height of the crista cutis A1, and the height of the sinking region A12 is equivalent to or even lower than the sulcus cutis A2. The crista cutis A1 and the protruding region A11 create a friction force with the object being grasped, while sulcus cutis A2 and sinking region A12 make it easier for the skin to form folds, which is conducive to muscle curling when grasping objects. When the muscles are more curled, the grasping force increases, and the increase in grasping force also leads to an increase in the friction force. In other words, the crista cutis A1, the sulcus cutis A2 and the chain-shaped section A3 will improve the grasping force of the hand and the friction force when grasping the object.

The glove structure in Document 1 only has grooves, and does not have the crista cutis A1, the sulcus cutis A2 and chain-shaped section A3, so the glove structure cannot effectively improve the grasping force and the friction force when grasping an object.

SUMMARY

To solve the technical problems of the related art, the present disclosure provides a glove structure which can increase a grasping force and a friction force when grasping an object.

The details of technical means adopted by the present disclosure are illustrated as follows.

A glove structure of the present disclosure at least comprises a glove core and at least a glove part, the glove core has an inner surface and an outer surface opposite to the inner surface, the glove part has a bottom surface and a top surface opposite to the bottom surface, and the bottom surface covers the outer surface of the glove core, wherein the glove part is formed with a lamination region which caves downwards from the top surface and has a long strip shape along an extending direction, the lamination region comprises an adhesion region, a bottom portion, a plurality of protruding portions and a plurality of sinking sections, and a portion of the top surface which is not formed with the lamination region has at least a non-lamination region; the adhesion region is formed under the lamination region, or an adhesive layer is disposed under the lamination region to form the adhesion region; the bottom portion is formed on the adhesion region, the protruding portions protrude upwards from the bottom portion, the protruding portions are spaced apart to each other and arranged in at least one row along the extending direction, and the sinking section is formed between the two adjacent protruding portions.

According to the above structural features, the adhesion region is bonded to the outer surface.

According to the above structural features, the non-lamination region, the bottom portion, the protruding portions and the sinking sections are formed in one piece.

According to the above structural features, the non-lamination region, the bottom portion, the protruding portions, the sinking sections and the adhesion region are formed in one piece.

According to the above structural features, a height distance between the protruding portion and the top surface is defined as a gap, and the gap is larger than 0.

According to the above structural features, a height distance between the sinking section and the top surface is defined as a sinking depth, a height distance between the bottom portion and the top surface is defined as a bottom portion depth, and the sinking depth is larger than or equal to the bottom portion depth.

According to the above structural features, a width distance between the protruding portion and the non-lamination region is defined as a half groove width, and the half groove width is larger than 0.

According to the above structural features, the half groove width between the protruding portion and the non-lamination region on a left side of the protruding portion is identical to or different from the half groove width between the protruding portion and the non-lamination region on a right side of the protruding portion.

According to the above structural features, the protruding portions of the lamination region of the glove part are spaced apart to each other and arranged in a plurality of parallel rows along the extending direction.

According to the above structural features, the glove structure comprises two glove parts being independent and spaced apart to each other, the lamination region of each of the glove parts is formed to have a distance to an edge of the top surface of the glove part, and the distance is less than or equal to 10 mm.

According to the above structural features, the protruding portions of the lamination region of each of the glove parts are spaced apart to each other and arranged in a plurality of parallel rows along the extending direction.

According to the above structural features, a modified glove part is formed between the glove core and the glove part.

According to the above structural features, the adhesion region is bonded to the modified glove part, and the modified glove part covers the outer surface of the glove core.

According to the above structural features, the protruding portion has a long strip shape, and a longitudinal direction of the long strip shape of the protruding portion is identical to the extending direction.

According to the above provided glove structure, technical results of the glove structure of the present disclosure are illustrated as follows.

According to the above structural features, the glove core of the glove structure of the present disclosure acts dermis of skin, and the glove part covering the glove core acts as epidermis of the skin. The glove part is formed with a lamination region which caves downwards from a top surface of the glove part and has a long strip shape, and the lamination region acts as sulcus cutis of the palm prints of the epidermis. Especially, the bottom portion between the protruding portion and the non-lamination region acts as sulcus cutis. The caved bottom portion of the lamination region are disposed with a plurality of protruding portions, and the protruding portions arranged along the extending direction of the lamination region act as the crista cutis. The protruding portions are spaced apart to each other, so as to act as the crista cutis which presents the chain-shaped section. The sinking section between the adjacent protruding portions acts as the sinking region of the adjacent crista cutis of the chain-shaped section. The glove structure of the present disclosure is to simulate the dermis and the epidermis of the skin, and thus the non-lamination region, the bottom portion, the protruding portions and the sinking sections of the glove part are formed in one piece. The glove structure of the present disclosure can effectively increase a grasping force and a friction force when grasping an object.

DESCRIPTIONS OF DRAWINGS

DESCRIPTIONS OF EMBODIMENTS

Figure 1:
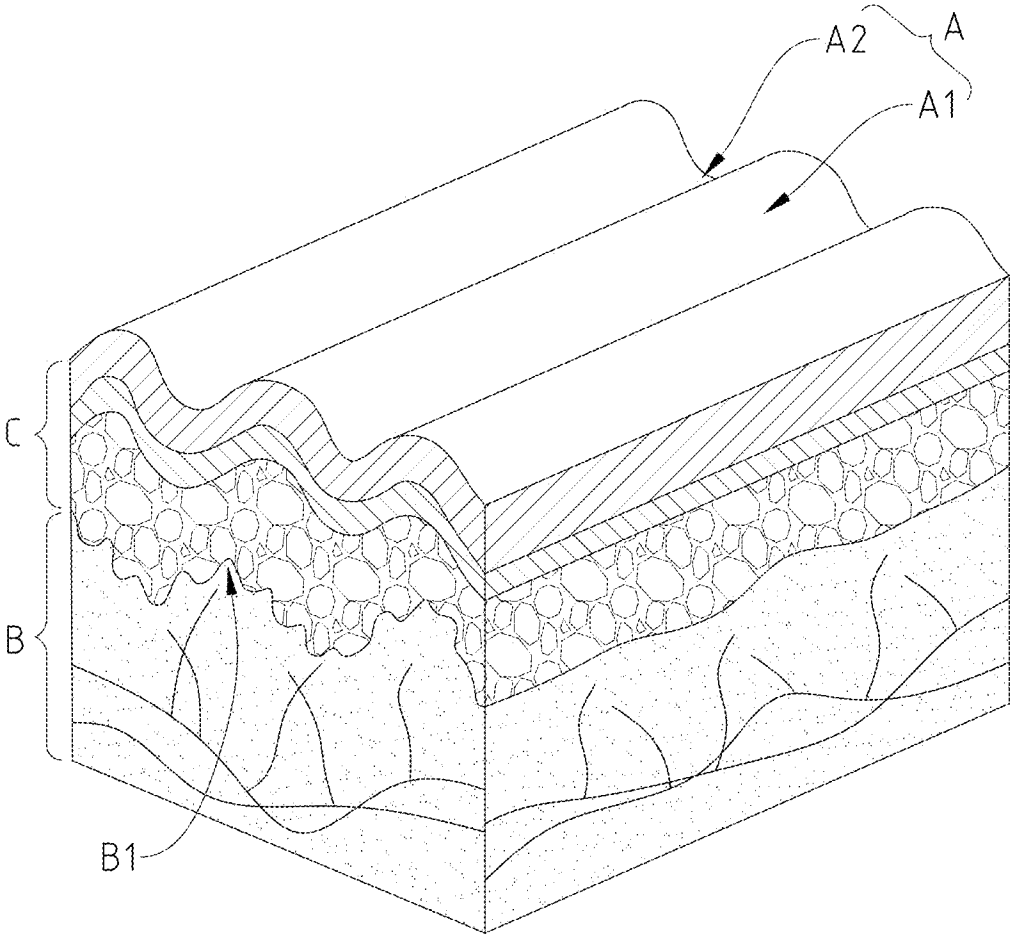
FIG. 1 is a cross-sectional view of known palm prints of a human palm and a partial structure of the human palm.
Figure 2A:
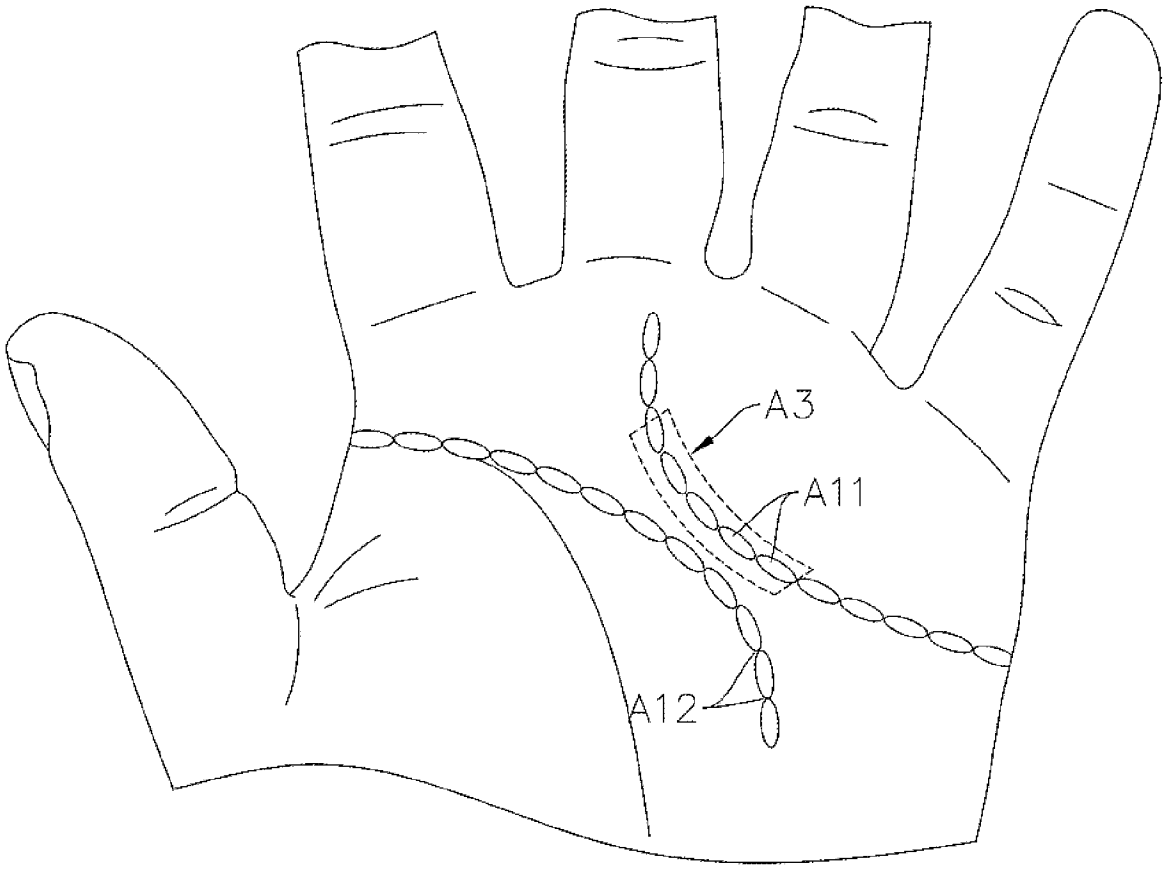
FIG. 2A is a view of known chain-shaped palm prints on a human palm.
Figure 2B:
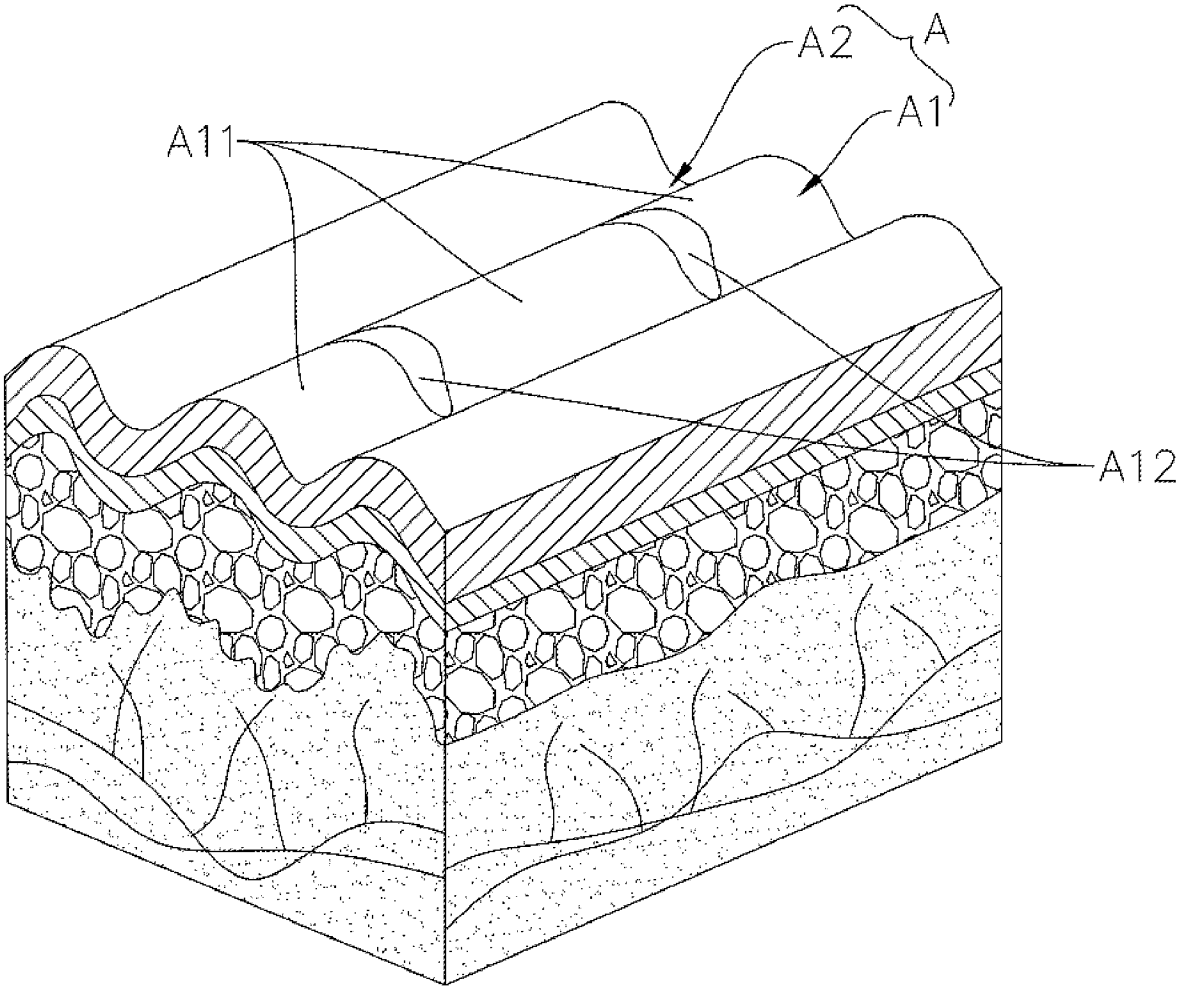
FIG. 2B is cross-sectional view of known chain-shaped palm prints on a human palm and a partial structure of the human palm.

Embodiments of the present disclosure will now be described, by way of example only, with reference to the accompanying drawings. The following drawings are dedicated for description, and they are schematic and exemplary, being not drawn and precisely allocated in accordance with the actual ratio, thus not limiting the present disclosure.

The present disclosure provides a glove structure 10, as shown in a first embodiment of FIG. 3A, FIG. 3B, FIG. 3C and FIG. 3D. A glove core 11 of the glove structure is covered by at least a glove part 21. The glove part 21 is used to produce preset functional properties such as anti-slip, anti-scratch, waterproof, heat insulation or electric insulation. The glove structure 10 of the present disclosure comprises a glove core 11 and a glove part 21. The glove core 11 has an inner surface 111 and an outer surface 112 opposite to the inner surface 111. The glove part 21 has a bottom surface 211 and a top surface 212 opposite to the bottom surface 211. The bottom surface 211 covers the outer surface 112 of the glove core 11. The glove structure 10 is characterized: the glove part 21 is formed with a lamination region 2120 which caves downwards from the top surface 212 and has a long strip shape along an extending direction X, the lamination region 2120 comprises an adhesion region 2121, a bottom portion 2122, a plurality of protruding portions 2123 and a plurality of sinking sections 2124, and a portion of the top surface 212 which is not formed with the lamination region 2120 has at least a non-lamination region 2125.

In practice, the glove core 11 of the present disclosure can be any object that looks like a glove. The glove core 11 of the glove structure 10 is made of cotton yarn, leather, plush, fiber, natural fiber, man-made fiber, non-woven fabric, plastic or rubber. The glove core 11 can be a knitted glove, a sewing glove or a woven glove, or the glove core 11 can be a dip coated glove formed by a dip coated method as disclosed in U.S. Pat. No. 7,803,438, or the glove core 11 can be an injection molded glove formed by injection molding as disclosed in China Patent No. 103415223. The glove part 21 of the present disclosure can be anything covering the glove core 11. The glove part 21 can be a piece made of cotton, leather, plush, fiber, natural fiber, man-made fiber, non-woven fabric, plastic or rubber, or the glove part 21 can be a dip coated component formed as disclosed in U.S. Pat. No. 7,803,438, or the glove part 21 can be an injection molded component formed by injection molding as disclosed in China Patent No. 103415223. The material of the glove part 21 can be the same as the material of the glove core 11; of course, the material of the glove part 21 can also be different from the material of the glove core 11. The adhesive layer can be made of Polyurethane (PU), polyacrylate, acrylate or other adhesive interface materials, and can be attached by applying adhesive film or brushing glue. Same as that of the related art, the glove core 11 can be divided into a palm part and a finger part. The palm part can be further divided into a palm surface, a palm side and a palm back. The finger part can be further divided into a finger surface, a finger side and a finger back. Of course, the glove core 11 can also have only the palm part without necessarily having the finger part, or the glove core 11 can also have only the finger part without having to have the palm part. It is particularly noted here that the palm part, the finger part, the palm surface, the palm side, the palm back, the finger surface, the finger side and the finger back are well known to common knowledge, and therefore the labels are omitted herein.

The glove structure 10 of the present disclosure uses the glove part 21 covering the glove core 11 as acting as the epidermis of the skin, so preferably, the glove part 21 can be a fiber woven fabric such as a microfiber woven nylon piece, or animal leather or artificial leather, to have both functions of protection and breathability. The glove part 21 of the glove structure 10 of the present disclosure caves downwards and has a long strip shape, so as to act as the sulcus cutis of the palm prints of the epidermis, especially, the bottom portion 2122 between the protruding portion 2123 and the non-lamination region 2125 acts as the sulcus cutis. The caved bottom portion 2122 of the lamination region 2120 has the protruding portions 2123 arranged in at least a row along the lamination region 2120, and the protruding portions 2123 act as the crista cutis. The protruding portion 2123 are spaced apart to each other to present the crista cutis of the chain-shaped section. The sinking section 2124 between the adjacent protruding portions 2123 acts as the sinking region between adjacent crista cutis of the chain-shaped section. Since the protruding portions 2123 are to simulate the crista cutis of the chain-shaped section, the protruding portion 2123 has a long strip shape, and a longitudinal direction of the long strip shape of the protruding portion 2123 is identical to the extending direction X. Of course, the protruding portion 2123 may have a hemisphere shape, or other shape. Since the glove part 21 of the glove structure 10 of the present disclosure is to simulate the epidermis of the skin, the non-lamination region 2125, the bottom portion 2122, the protruding portions 2123 and the sinking sections 2124 of the glove part 21 are formed in one piece. When the palm prints corresponding to the human palm are straight lines in a certain section, the extending direction X can be a straight extension line; and when the palm prints corresponding to the human palm are curved in another section, the extending direction X can be an extension curve.

Figure 4A:
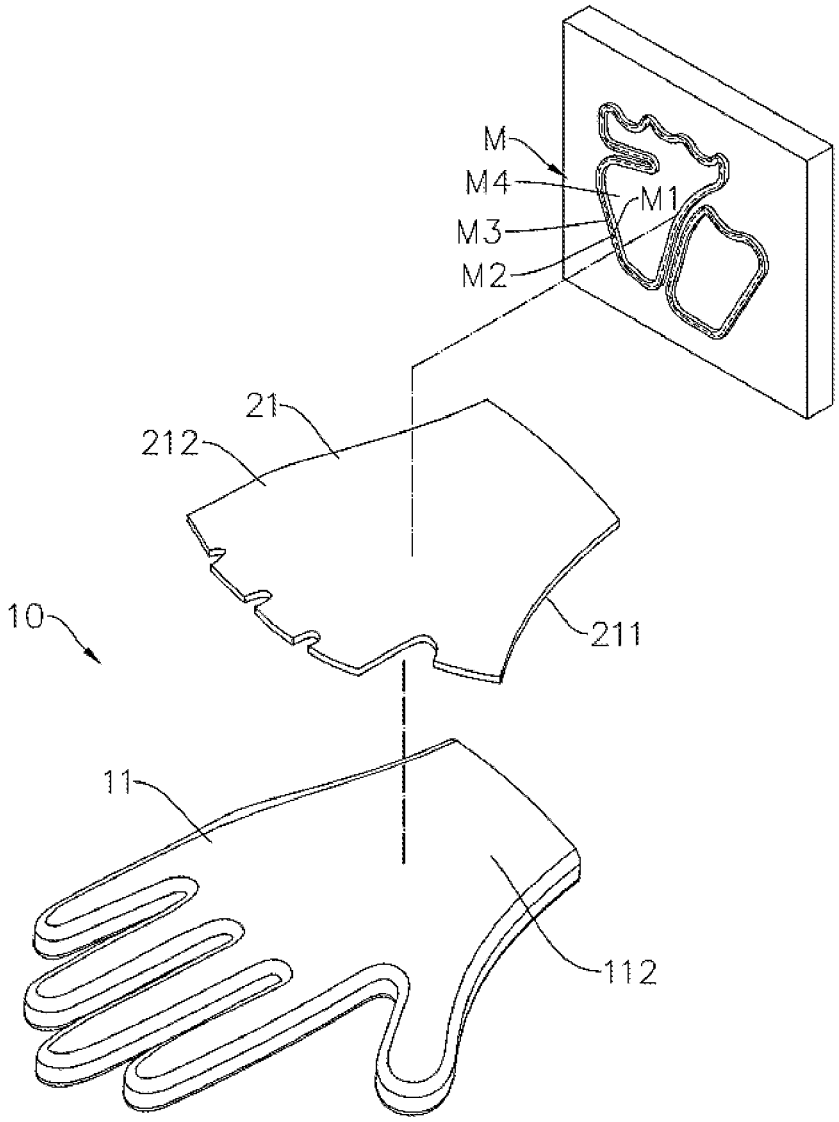
FIG. 4A is a view of a manufacturing method of a glove structure of the present disclosure when a mold is adopted.
Figure 4B:
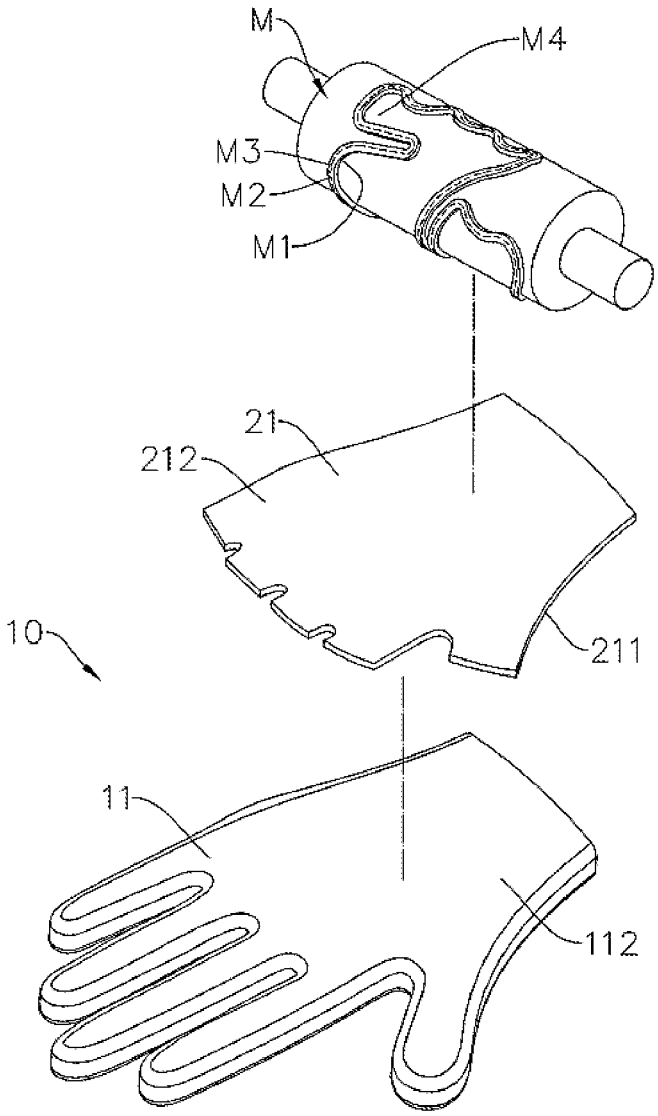
FIG. 4B is a view of a manufacturing method of a glove structure of the present disclosure when a hot pressure roller is adopted.

Referring to FIG. 4A, the glove structure 10 of the present disclosure can be manufactured by using a glove structure manufacturing method. The glove structure manufacturing method firstly cuts the glove part 21 to have a specific contour shape, and then positions the glove part 21 to cover the preset position of the glove core 11, such as the palm surface. Next, the glove structure manufacturing method uses a mold M to cover the glove part 21 and apply heat and pressure to the glove part 21. The mold M has a plurality of regions which are a positive engraved pattern of a first region M1, a negative engraved pattern of a second region M2, and a positive engraved pattern of a third region M3. The first region M1, the second region M2 and the third region M3 of the mold M are respectively corresponding to the bottom portion 2122, the protruding portions 2123 and the sinking sections 2124 of the lamination region 2120, such that the glove part 21 is formed with the lamination region 2120, the protruding portions 2123 and the sinking sections 2124. Of course, the mold M in FIG. 4A can further have a positive engraved pattern of a first region M4 corresponding to the non-lamination region 2125 according to actual requirements. A depth of the fourth region M4 is obviously greater than a depth of the second region M2. The method of heating the mold M may be to use ultrasonic waves, high frequency waves, electric heating or any other method that can heat the mold M. The glove part 21 can be made of hot-melt material, such as woven fabric made of nylon fiber, a non-woven fabric made of nylon fiber, any piece containing hot-melt material, the aforementioned dipped component or the aforementioned injection molded component. Therefore, when the mold M is heated beyond the melting point of the hot-melt material and is pressurized on the glove part 21, the region of the glove part 21 that is heated and pressurized by the mold M will be hot-melt to flow to form the lamination region 2120, the protruding portions 2123, the sinking sections 2124 and the adhesion region 2121, and the adhesion region 2121 is formed at the bottom part of the lamination region 2120 and bonded to the outer surface 112, so that the glove part 21 is fixed to the glove core 11. Accordingly, the bottom portion 2122, the protruding portions 2123, the sinking sections 2124 and the adhesion region 2121 are formed in one piece, and also integrally formed with the non-lamination region 2125. Referring to FIG. 4B, the mold M can also be a hot pressure roller, which also has the first region M1, the second region M2 and the third region M3.

The glove structure manufacturing method firstly cuts the glove part 21 to have a specific contour shape, disposes an adhesive layer (such as hot melt glue or self-adhesive) below the glove part 21 to form the adhesion region 2121, and positions the glove part 21 to cover the preset position of the glove core 11, such as the palm surface. Next, the glove structure manufacturing method uses the mold M to cover the glove part 21 and apply heat and pressure to the glove part 21. The mold M has a plurality of regions which are a positive engraved pattern of a first region M1, a negative engraved pattern of a second region M2, and a positive engraved pattern of a third region M3. The mold M has a plurality of regions which are a positive engraved pattern of a first region M1, a negative engraved pattern of a second region M2, and a positive engraved pattern of a third region M3. The first region M1, the second region M2 and the third region M3 of the mold M are respectively corresponding to the lamination region 2120, the protruding portions 2123 and the sinking sections 2124, such that the glove part 21 is formed with the bottom portion 2122, the protruding portions 2123 and the sinking sections 2124 of the lamination region 2120. This method is especially suitable when the glove part 21 is leather, such as animal leather or artificial leather. At this time, the heating temperature of the mold M can be set to be higher than the glass transition temperature (Tg) of the leather, so that the leather has the property of softening and deforming. In other words, the adhesion region 2121 is not formed integrally with the non-lamination region 2125, the bottom portion 2122, the protruding portions 2123 and the sinking sections 2124.

Figure 3A:
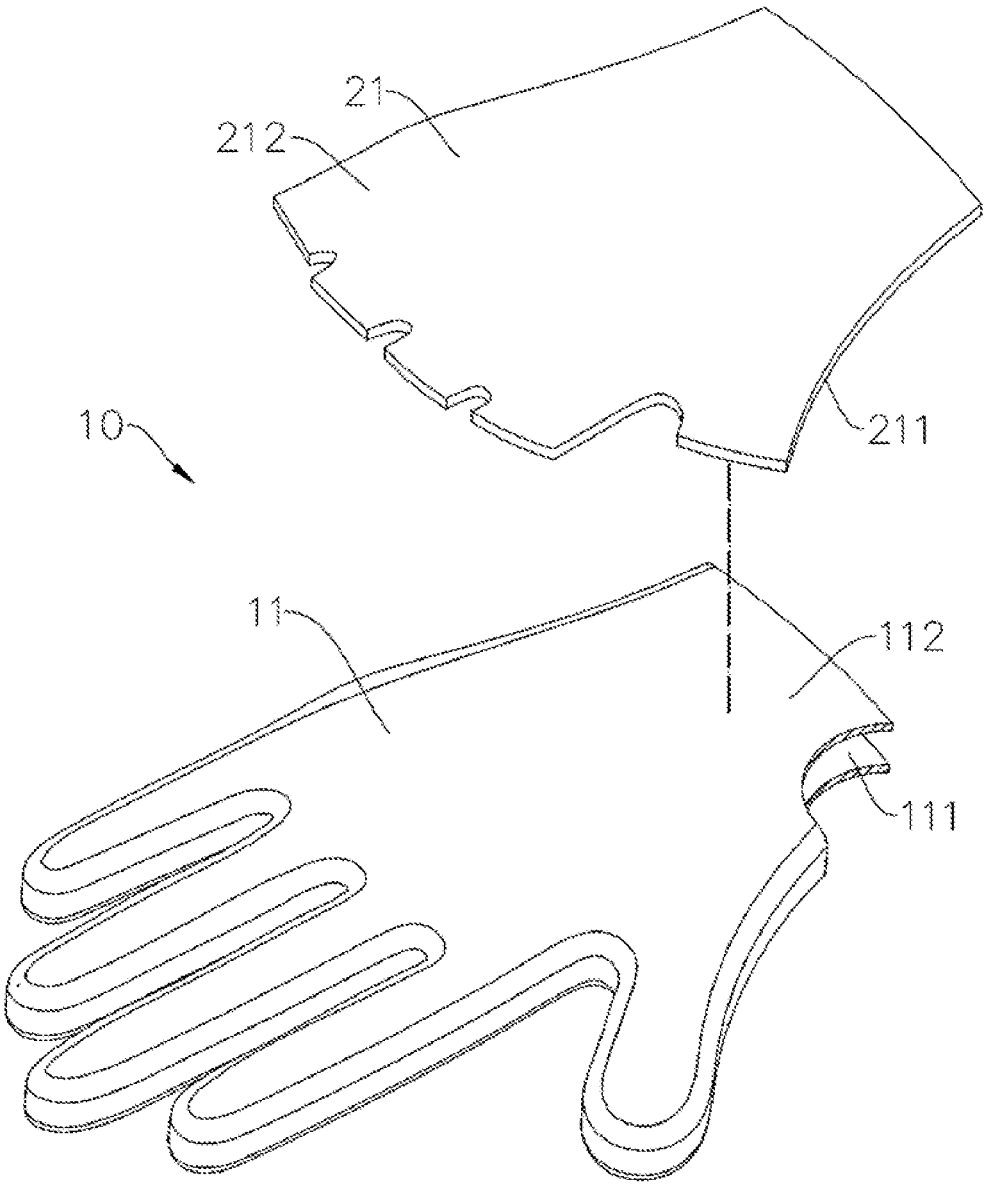
FIG. 3A is a structural view of a glove structure of a first embodiment of the present disclosure when a glove core is separated from a glove part.
Figure 3B:
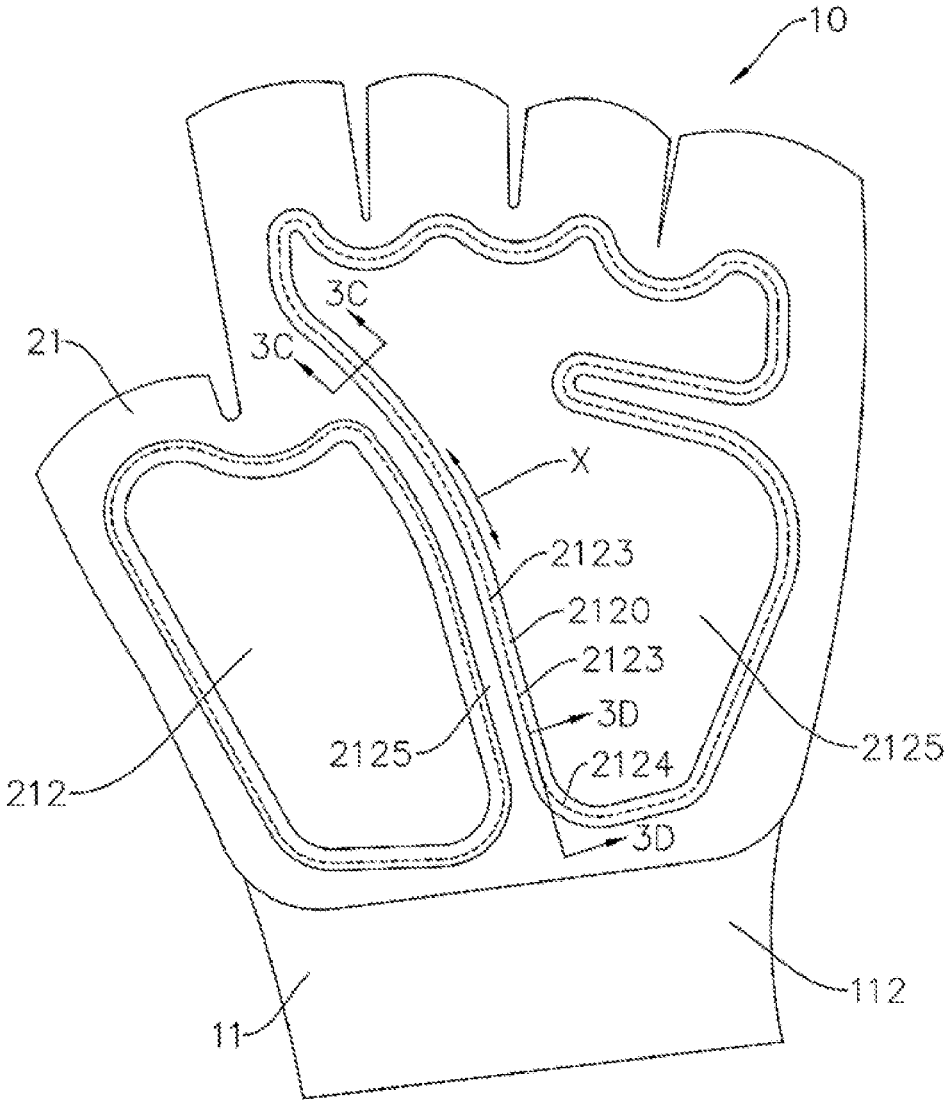
FIG. 3B is a structural view of a glove structure of a first embodiment of the present disclosure when a glove core is bonded to a glove part.
Figure 3C:
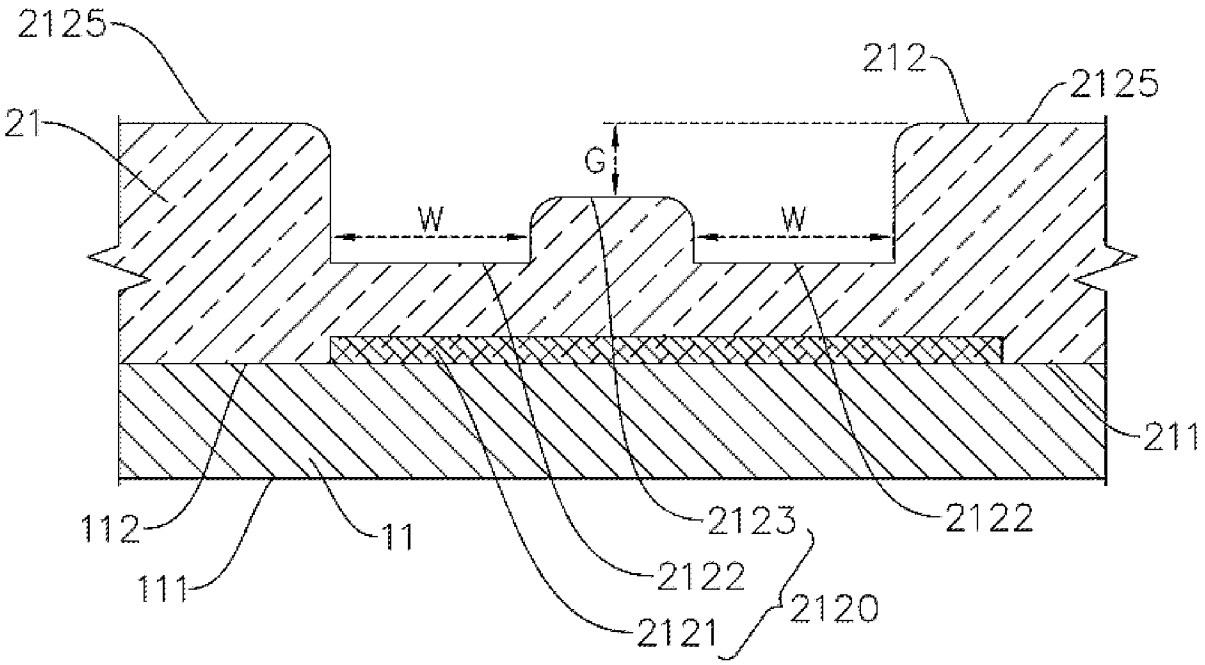
FIG. 3C is a cross-sectional view of a line 3C-3C of FIG. 3B.
Figure 3D:
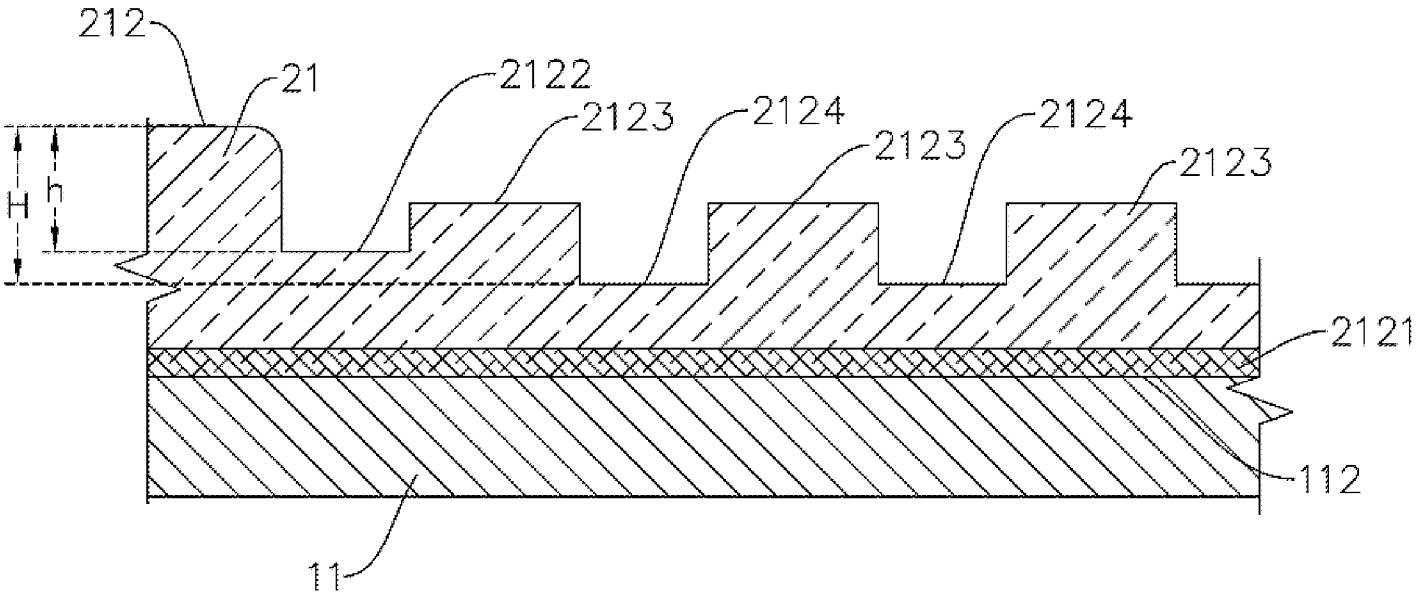
FIG. 3D is a cross-sectional view of a line 3D-3D of FIG. 3B.
Figure 5:
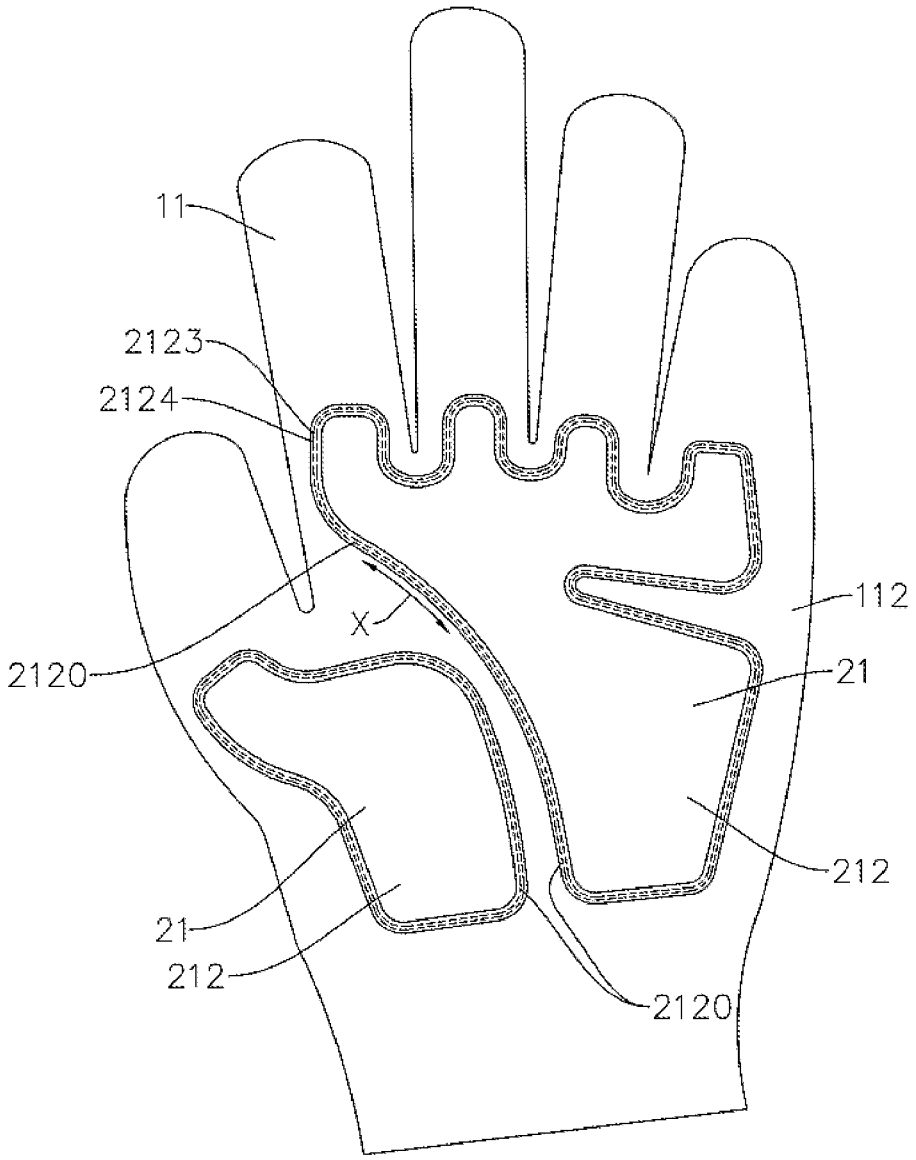
FIG. 5 is a view of a glove structure of a second embodiment of the present disclosure.

Referring to the second embodiment of FIG. 5, the cross-sectional views of the second embodiment are the same as FIG. 3C and FIG. 3D of the first embodiment, and thus the same drawings and descriptions are omitted herein. The lamination region 2120 of the glove structure 10 of the second embodiment of the present disclosure is formed to have a distance to an edge of the top surface 212 of the glove part 2120, and the distance is less than or equal to 10 mm, preferably, less than or equal to 5 mm. Preferably, the glove structure 10 comprises a plurality of glove parts 21, for example, in FIG. 5, the glove structure 10 comprises two glove parts 21 being independent and spaced apart to each other, the lamination region 2120 of each of the glove parts 21 is formed to have a distance to an edge of the top surface 212 of the glove part 2120, and the distance is less than or equal to 10 mm. The non-lamination regions 2125 of the two glove parts 21 may be of the same or different materials or properties, such as the same or different Shore hardness or surface friction coefficient. The protruding portions 2123 of the lamination region 2120 of each of the glove parts 21 are spaced apart to each other and arranged in a plurality of parallel rows along the extending direction X. For example, in FIG. 5, the protruding portions 2123 arranged in two parallel rows, and the protruding portions 2123 of each row are spaced apart to each other. In the lower part of FIG. 5, the protruding portions 2123 of the two corresponding lamination regions 2120 of the two glove parts 21 are arranged in totally four parallel rows, and therefore there are four rows acting as the crista cutis of the palm prints of the epidermis associated with the chain-shaped sections. The region between the two corresponding lamination regions 2120 formed by the two glove parts 21 can also be regarded as the sulcus cutis in the palm prints of epidermis of human skin. Therefore, there are four rows of crista cutis showing the sulcus cutis of the chain-shaped section. In other words, the protruding portions 2123 in the two corresponding lamination regions 2120 formed by the two glove parts 21 are arranged in parallel rows, and the protruding portions 2123 in each row are spaced apart to each other.

Figure 6A:
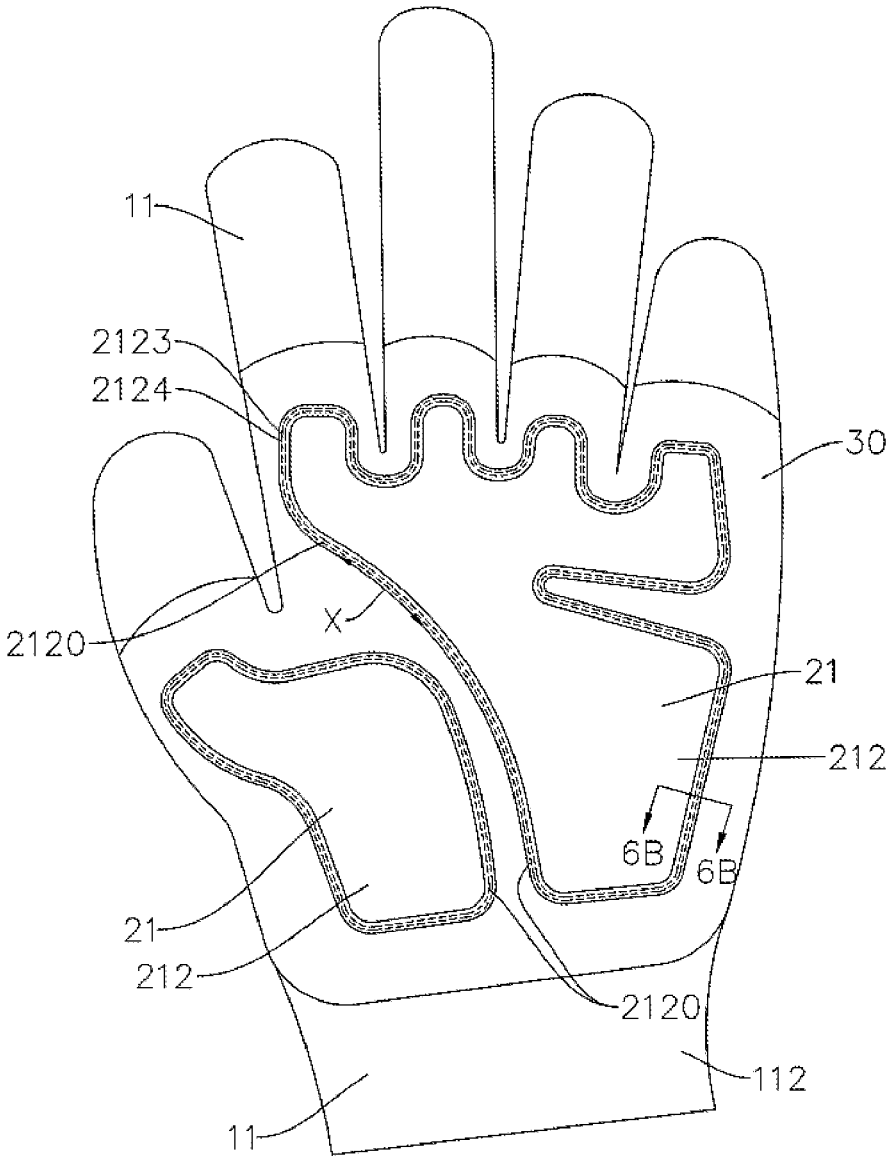
FIG. 6A is a view of a glove structure of a third embodiment of the present disclosure.
Figure 6B:
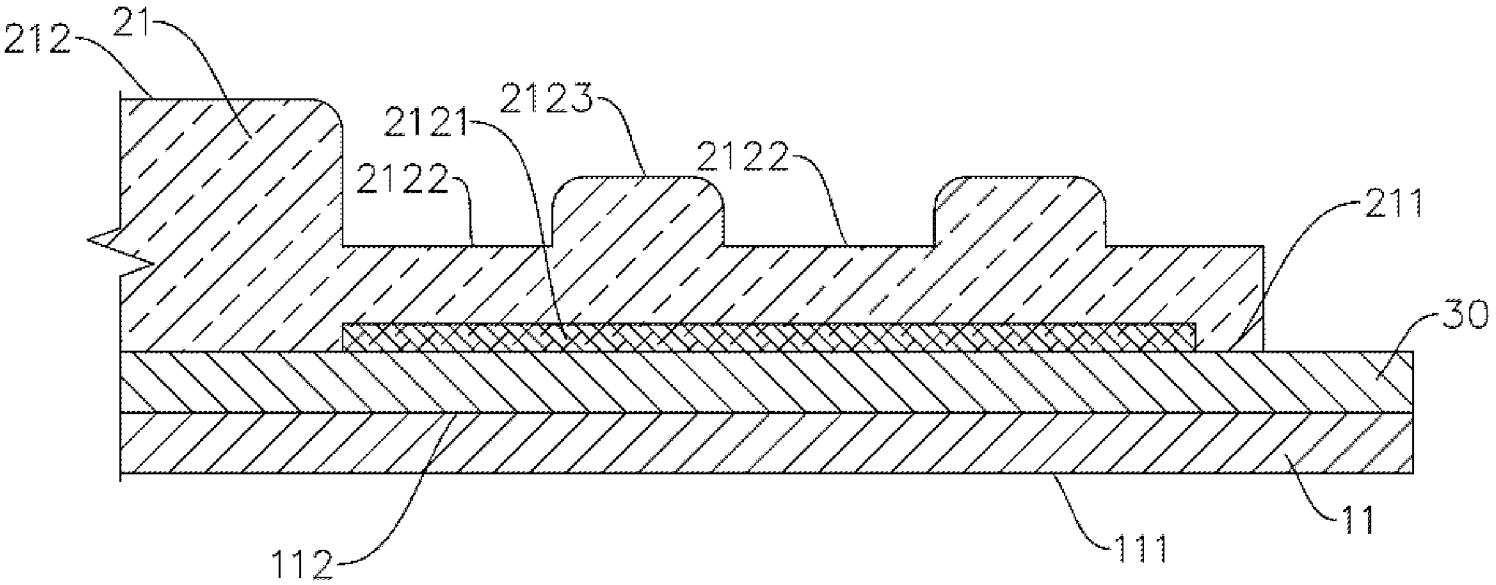
FIG. 6B is a structural cross-sectional view of a line 6B-6B of a glove structure of a third embodiment of the present disclosure.

Referring to the third embodiment of FIG. 6A and FIG. 6B, when the bonding strength between the outer surface 112 of the glove core 11 and the adhesion region 2121 of the glove part 21 is insufficient (for example, when the glove core 11 is a knitted glove, and the pores of the knitted glove are too large, resulting the bonding strength between the outer surface 112 of the glove core 11 and the adhesion region 2121 of the glove part 21 is insufficient), a modified glove part 30 can be formed between the glove core 11 and the glove part 21. The modified glove part 30 can be a sheet-shaped piece made of cotton, leather, plush, fiber, natural fiber, man-made fiber, non-woven fabric, plastic or rubber, or it can be a dipped component formed by dipping, or an injection molded component formed by injection molding. The similar descriptions of the third embodiment and the first embodiment will not be repeated again. The difference between the third embodiment and the first embodiment is that the adhesion region 2121 of the third embodiment is fixed to the modified glove part 30 and the modified glove part 30 covers the outer surface 112 of the glove core 11. Preferably, the modified glove part 30 is adhered to the outer surface 112 of the glove core 11. For example, the modified glove part 30 is a dipped component formed by dipping or an injection molded component formed by injection molding, as mentioned above. Naturally, the non-lamination region 2125, the bottom portion 2122, the protruding portions 2123, the sinking sections 2124 and the adhesion region 2121 are formed in one piece; or alternatively, the adhesion region 2121 can be an adhesive layer made of hot melt glue or self-adhesive, and in the situation, the adhesion region 2121 is not formed integrally with the non-lamination region 2125, the bottom portion 2122, the protruding portions 2123 and the sinking sections 2124.

Compared to the related art, the glove core 11 of the glove structure 10 of the present disclosure acts the dermis of skin, and the glove part 21 covering the glove core 11 acts as the epidermis of the skin. The glove part 21 is formed with the lamination region 2120 being caved and in a long strip shape, and the lamination region 2120 acts the sulcus cutis of the palm prints of the epidermis of the skin. Especially, the bottom portion 2122 between the protruding portion 2123 and the non-lamination region 2125 acts as sulcus cutis. The caved bottom portion 2122 of the lamination region 2120 has the protruding portions 2123, and the protruding portions 2123 arranged along the extending direction X of the lamination region 2120 act as the crista cutis. The protruding portions 2123 are spaced apart to each other, so as to act as the crista cutis which presents the chain-shaped section. The sinking section 2124 between the adjacent protruding portions 2123 acts as the sinking region of the adjacent crista cutis of the chain-shaped section. Since the glove structure 10 of the present disclosure is to simulate the dermis and the epidermis of the skin, the non-lamination region 2125, the bottom portion 2122, the protruding portions 2123 and the sinking sections 2124 of the glove part 21 are formed in one piece. The protruding portions 2123 form the friction force with the object being grasped, and the lamination region 2120 and the sinking sections 2124 make it easier for the glove part 21 to form wrinkles, which is beneficial to the curling of the glove structure 10 when grasping the object, wherein the lamination region 2120 makes the glove part 21 prone to form wrinkles along the extending direction X, and the sinking sections 2124 makes the glove part 21 prone to form wrinkles along a vertical direction of the extending direction X. Thus, when grasping an object, the glove structure 10 is prone to curling and increases the grasping force to the object, and the increase in grasping force also leads to an increase in the friction force.

Although particular embodiments of the present disclosure have been described in detail for purposes of illustration, various modifications and enhancements may be made without departing from the spirit and scope of the present disclosure. Accordingly, the present disclosure is not to be limited except as by the appended claims.

What is claimed is:

1. A glove structure, at least comprising a glove core and at least a glove part, the glove core has an inner surface and an outer surface opposite to the inner surface, the glove part has a bottom surface and a top surface opposite to the bottom surface, and the bottom surface covers the outer surface of the glove core, wherein the glove part is formed with a lamination region which caves downwards from the top surface and is a long strip shape along an extending direction, the lamination region comprises an adhesion region, a bottom portion, a plurality of protruding portions and a plurality of sinking sections, and a portion of the top surface which is not formed with the lamination region is a non-lamination region;

the adhesion region is formed under the lamination region, or an adhesive layer is disposed under the lamination region to form the adhesion region; the bottom portion is formed on the adhesion region, the plurality of protruding portions protrude upwards from the bottom portion, the plurality of protruding portions are spaced apart to each other and arranged in at least one row along the extending direction, and one of the plurality of sinking sections is formed between an adjacent two of the plurality of protruding portions;

wherein the extending direction is extended along with an edge of the non-lamination region.

2. The glove structure of claim 1, wherein the adhesion region is bonded to the outer surface.

3. The glove structure of claim 2, wherein the non-lamination region, the bottom portion, the plurality of protruding portions and the plurality of sinking sections are formed in one piece.

4. The glove structure of claim 3, wherein the non-lamination region, the bottom portion, the plurality of protruding portions, the plurality of sinking sections and the adhesion region are formed in one piece.

5. The glove structure of claim 3, wherein a height distance between one of the plurality of protruding portions and the top surface is defined as a gap, and the gap is larger than 0.

6. The glove structure of claim 5, wherein a height distance between one of the plurality of sinking sections and the top surface is defined as a sinking depth, a height distance between the bottom portion and the top surface is defined as a bottom portion depth, and the sinking depth is larger than or equal to the bottom portion depth.

7. The glove structure of claim 6, wherein a width distance between the one of the plurality of protruding portions and the non-lamination region is defined as a half groove width, and the half groove width is larger than 0.

8. The glove structure of claim 7, wherein the half groove width between the one of the plurality of protruding portions and the non-lamination region on a left side of the one of the plurality of protruding portions is identical to or different from the half groove width between the one of the plurality of protruding portions and the non-lamination region on a right side of the one of the plurality of protruding portions.

9. The glove structure of claim 1, wherein the plurality of protruding portions of the lamination region of the glove part are spaced apart to each other and arranged in a plurality of parallel rows along the extending direction.

10. The glove structure of claim 1, wherein the glove structure comprises two glove parts being independent and spaced apart to each other, the lamination region of each of the glove parts is formed to have a distance to an edge of the top surface of the glove part, and the distance is less than or equal to 10 mm.

11. The glove structure of claim 10, wherein the plurality of protruding portions of the lamination region of each of the glove parts are spaced apart to each other and arranged in a plurality of parallel rows along the extending direction.

12. The glove structure of claim 1, wherein a modified glove part is formed between the glove core and the glove part.

13. The glove structure of claim 12, wherein the adhesion region is bonded to the modified glove part, and the modified glove part covers the outer surface of the glove core.

14. The glove structure of claim 1, wherein one of the plurality of protruding portions has a long strip shape, and a longitudinal direction of the long strip shape of the one of the plurality of protruding portions is identical to the extending direction.

15. The glove structure of claim 1, wherein the lamination region is formed to have a distance to the edge of the non-lamination region and the distance is less than or equal to 10 mm.

16. The glove structure of claim 15, wherein the distance is less than or equal to 5 mm.

* * * * *